US011149912B2

(12) United States Patent
Rao et al.

(10) Patent No.: US 11,149,912 B2
(45) Date of Patent: Oct. 19, 2021

(54) EMERGENCY HIGH BAY LIGHT

(71) Applicant: Litetronics International, Inc., Bedford Park, IL (US)

(72) Inventors: Raghu Rao, Romeoville, IL (US); Robert Sorensen, Bedford Park, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 16/782,778

(22) Filed: Feb. 5, 2020

(65) Prior Publication Data

US 2021/0239283 A1 Aug. 5, 2021

(51) Int. Cl.

| | |
|---|---|
| ***F21S 9/02*** | (2006.01) |
| ***F21V 23/00*** | (2015.01) |
| ***F21V 23/04*** | (2006.01) |
| ***H05B 47/195*** | (2020.01) |
| ***F21Y 105/18*** | (2016.01) |
| ***F21Y 115/10*** | (2016.01) |

(52) U.S. Cl.

CPC ..... *F21S 9/022* (2013.01); *F21V 23/003* (2013.01); *F21V 23/045* (2013.01); *F21V 23/0435* (2013.01); *H05B 47/195* (2020.01); *F21Y 2105/18* (2016.08); *F21Y 2115/10* (2016.08)

(58) Field of Classification Search

CPC .... F21S 9/022; F21V 23/003; F21V 23/0435; F21V 23/045; F21V 23/0457; H05B 47/195

See application file for complete search history.

(56) References Cited

U.S. PATENT DOCUMENTS

| | | | | |
|---|---|---|---|---|
| 5,148,158 | A * | 9/1992 | Shah | G08B 29/126 315/86 |
| 5,929,781 | A * | 7/1999 | Vosika | G08B 29/126 315/134 |
| 6,392,349 | B1 * | 5/2002 | Crenshaw | H02J 9/02 315/150 |
| 6,828,733 | B1 * | 12/2004 | Crenshaw | H02J 9/02 315/150 |
| 10,616,970 | B2 * | 4/2020 | Johnson | H02J 7/0021 |
| 2002/0080027 | A1 * | 6/2002 | Conley, III | H05B 47/19 340/540 |
| 2004/0062055 | A1 * | 4/2004 | Rozenberg | G08B 7/066 362/555 |
| 2010/0237702 | A1 * | 9/2010 | Stocker | H02J 9/06 307/66 |
| 2013/0342131 | A1 * | 12/2013 | Recker | H02J 50/40 315/292 |
| 2014/0119013 | A1 * | 5/2014 | Rapeanu | F21V 5/04 362/242 |
| 2014/0292506 | A1 * | 10/2014 | Rapeanu | F21S 9/022 340/514 |
| 2015/0330587 | A1 * | 11/2015 | Lax | F21V 23/04 362/191 |
| 2017/0307154 | A1 * | 10/2017 | Duckworth | F21S 9/022 |

* cited by examiner

*Primary Examiner* — William N Harris

(74) *Attorney, Agent, or Firm* — Steve Witters; Witters & Associates

(57) ABSTRACT

Technologies are described for emergency lighting, provided is a stand-alone emergency high bay light having an array of LEDs disposed symmetrically about a central axis of the emergency high bay light. A rechargeable battery is configured to illuminate the array of LEDs. The emergency high bay light is configured to charge the rechargeable battery with a power supply between about 100V AC and 480V AC.

19 Claims, 2 Drawing Sheets

EMERGENCY HIGH BAY LIGHT

FIELD OF THE DISCLOSURE

Figure 1:
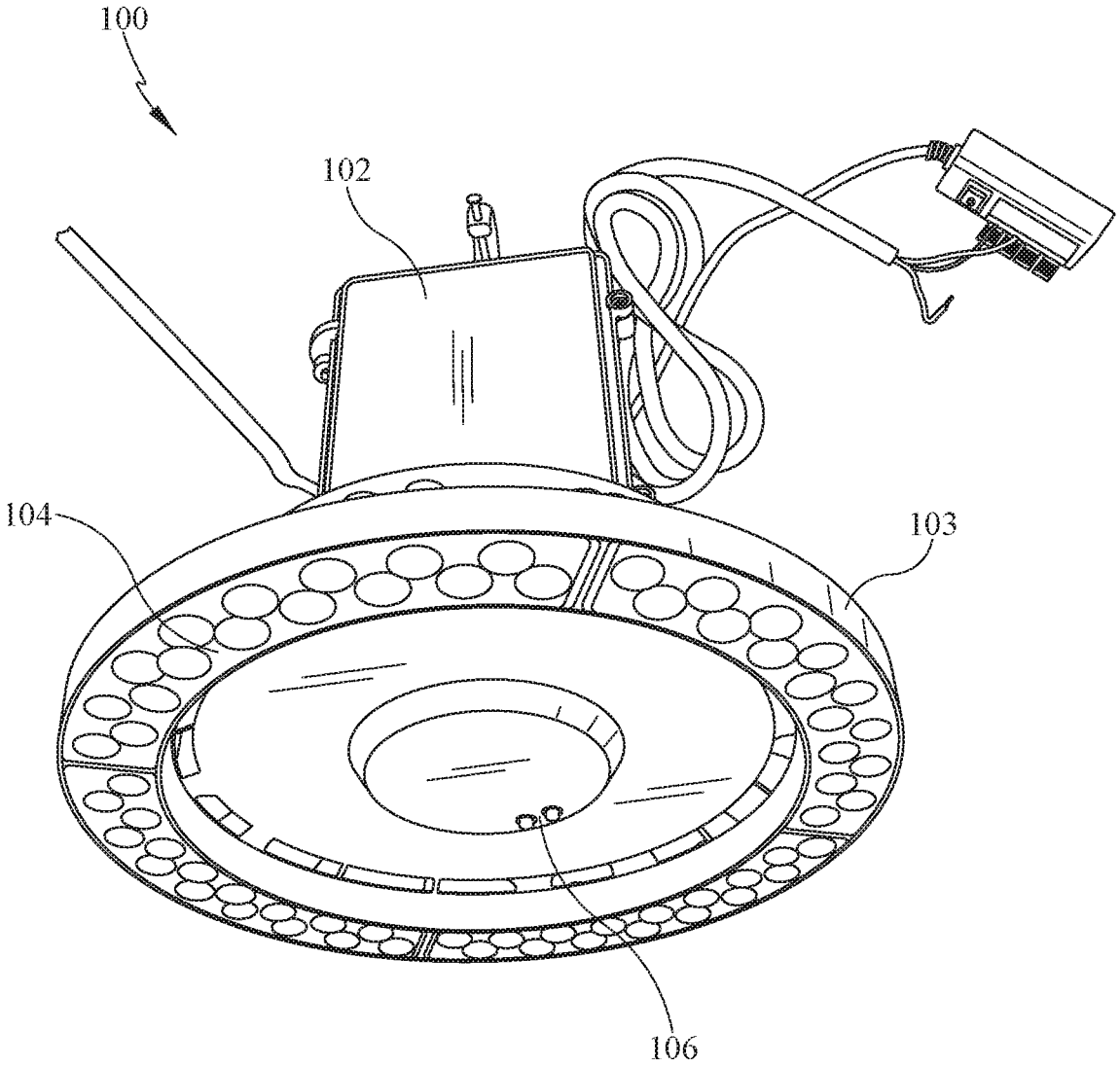

This invention generally relates to emergency lighting systems and emergency high bay lights.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Upon an interruption in a power supply or power failure, it is often desired, or even required, to have emergency light. For example, emergency lighting, or "egress lighting", may be needed to provide for automatic illumination in the event of an interruption in the power supply. Emergency lighting may be required under government regulations and may be designed to illuminate and identify hallways, stairwells, and exits to facilitate safe and orderly evacuation from a structure.

Typically, emergency lights, lamps, or luminaires are installed near an area or floor to be illuminated to provide adequate illumination for egress in the event of a power outage.

SUMMARY

In at least one embodiment of the present disclosure, a stand-alone emergency high bay light comprises an array of LEDs disposed symmetrically about a central axis of the emergency high bay light, a rechargeable battery configured to illuminate the array of LEDs, wherein the emergency high bay light is configured to charge the rechargeable battery with a power supply between about 100V AC and 480V AC.

In at least one other embodiment of the present disclosure, an emergency high bay light comprises an array of LEDs disposed on a lower surface and symmetrically about a central axis of the emergency high bay light. A housing extends up from the array of LEDs, the housing being configured to be opened and closed. A rechargeable battery is removably housed in the housing and is configured and disposed to illuminate the array of LEDs. The emergency high bay light is configured to charge the rechargeable battery with a power supply between about 100V AC and 480V AC.

BRIEF DESCRIPTIONS OF THE DRAWINGS

Figure 2:
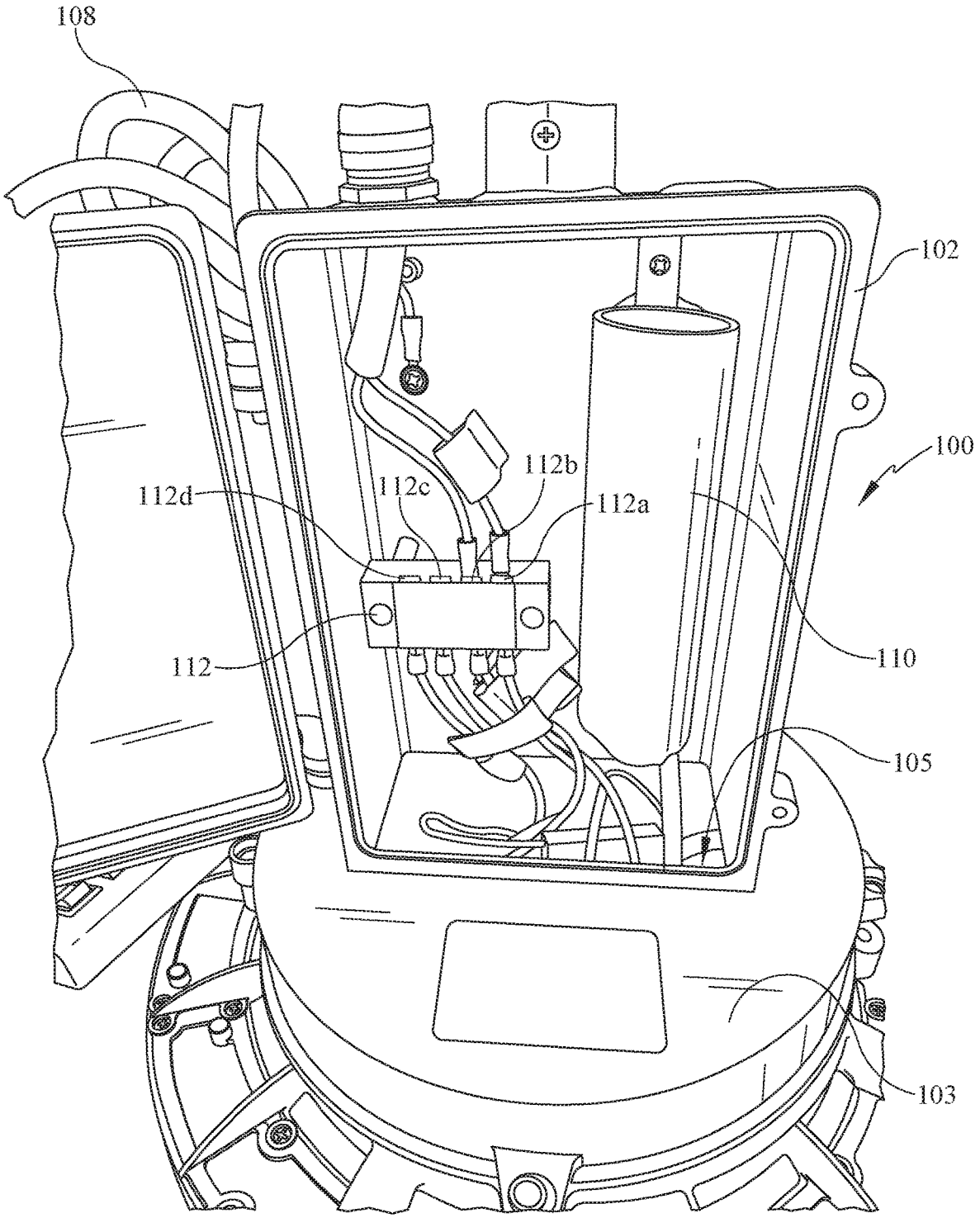

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements may be depicted by like reference numerals. The drawings are briefly described as follows:

FIG. 1 shows a lower perspective view of an illustrative example of the emergency high bay light of the present disclosure; and FIG. 2 is an upper perspective view of the emergency high bay shown in FIG. 1, showing electrical components and connectors.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

In at least one embodiment of the present disclosure, the emergency high bay light has electrical circuitry in electrical communication with a rechargeable battery, a light source, and a power supply. The electrical circuitry may be configured and disposed to switch a power supply to the light source to supply power with the battery. For example, the presently emergency high bay light may be configured to provide emergency light with battery power upon an interruption of power from an external power supply.

The presently disclosed emergency high bay light is configured to be installed at a distance from the area to be illuminated with egress light. For example, the emergency high bay light of the present disclosure may be configured to be installed at a height of about ten to twelve fey t, or less, about twelve to fifteen feet, or more, in fractions of an inch, above a floor and provide emergency lighting with an initial illumination of not less than an average of one foot-candle (10.8-lux) and a minimum at any point of 0.1-foot-candle (1.1-lux), measured along the path of egress at floor level, for a period of at least 90 minutes.

In at least one embodiment, the presently disclosed emergency high bay emergency light may be configured to be used as a high bay light. High bay lighting is often used for general lighting for industrial buildings. For example, emergency high bay lights are typically installed at least 12 or at least 15 feet above a floor. The presently disclosed emergency high bay light is configured to provide emergency lighting upon a power loss, with a backup power source. For example, the presently disclosed emergency high bay emergency light may be in electrical communication with a battery or have a battery in its housing.

It is to be understood that the presently disclosed emergency high bay emergency light may have a variety of configurations. For example, the emergency high bay light may be fixed such as ceiling dome, recessed, cove, troffer, pendant, sconce, track, emergency, exit, high-bay, low-bay, strip, industrial, decorative, flood, longitudinal extending, or have other configurations of lights as are known in the art. The light source of the emergency high bay emergency light may be arc, fluorescent, gas-discharge, high-intensity discharge lamp (HID), mercury-vapor lamp, metal-halide, sodium vapor, neon incandescent, halogen, LED, low-voltage LED, quantum dot, or other light source as is known in the art. In at least one embodiment, the presently disclosed emergency high bay emergency light has an array of LEDs.

The presently disclosed emergency high bay has a rechargeable battery in electrical communication with its light source. The rechargeable battery is in electrical communication with a power supply for charging. In at least one embodiment, the battery may be in wireless communication with its light source and/or the power supply. For example, the electronics may be configured for inductive powering the light source and/or charging the battery wirelessly with an electromagnetic field and transferring energy using electromagnetic induction.

The presently disclosed emergency high bay light may have an emergency light tester configured to remotely or directly test the operation of the electrical circuitry, the battery, and its light source. In at least one embodiment, the presently disclosed emergency high bay light has a wireless emergency light tester with wireless communications circuitry configured for the remote testing of the operation of the electrical circuitry, the battery, and the light source. For example, the presently disclosed emergency high bay light may be configured to be operated and/or tested remotely with a portable wireless device such as a smart phone, tablet, or other wireless communications device, or with an IR or microwave remote.

FIGS. 1 and 2, respectively, show lower and upper perspective views of emergency high bay light 100. In at least one embodiment, emergency high bay light 100 has a stand-alone configuration. For example, emergency high bay light 100 may be a complete system configured to provide emergency egress light. In the prior art, most if not all, high bay emergency lights are not stand-alone since they are not complete systems. The prior high bay lights are fitted with circuitry and a battery to provide emergency lighting. Conversely, the presently disclosed emergency high bay light 100 has battery 110 removably housed in housing 102 and has all sensors and circuitry for illuminating light source 104 upon an interruption in a power supply.

An array of LEDs 104 are disposed symmetrically about a central axis of the emergency high bay light 100. For example, the array of LEDs 104 may be symmetrically disposed on a lower surface of light source support 103. Light source support 103 may be configured house circuitry such as testing circuitry and/or a transformer and/or electrical connectors for providing power to light source 104.

In at least one embodiment of the present disclosure, emergency high bay light 100 has electrical circuitry in electrical communication with a rechargeable battery 110, the array of LEDs 104, and an external power supply. The electrical circuitry may be configured and disposed to electrically connect battery 110 to the array of LEDs 104 upon an interruption in an external power supply. For example, emergency high bay light 100 is configured to provide emergency egress light upon an interruption of power from an external power supply.

Testing indicator and/or control 106 may be disposed on a lower surface of light source support 103. Testing indicator and/or control 106 may be configured for manual and/or remote testing the operational status of emergency high bay light 100. For example, testing indicator and/or control 106 may have a button and a light for manually testing emergency high bay light 100 by pressing the button and observing the color, or other status indication means, of the light for indicating the status of emergency high bay light 100. It is to be understood that testing indicator and/or control 106 may be configured for remote testing and the button may not be necessary for testing. In at least one embodiment, emergency high bay light 100 has a test switch and an indicator light, the test switch being configured for testing the operation of the stand-alone emergency high bay light and the indicator light being configured to indicate the operational status of the emergency high bay light 100.

In at least one embodiment, emergency high bay light 100 has a wireless emergency light tester with wireless communications circuitry configured for the remote testing of the operation of the electrical circuitry, battery 110, and the light source 104. For example, emergency high bay light 100 may be configured to be operated and/or tested remotely with a portable wireless device such as a smart phone, tablet, or other wireless communications device. For example, emergency high bay light 100 may have at least one of Wi-Fi and Bluetooth connectivity and configured for the testing with a remote mobile device. In at least one embodiment, emergency high bay light 100 is configured to be remotely tested with a microwave or IR remote control.

A rechargeable battery 110 is configured and disposed to illuminate the array of LEDs 104 upon a power interruption. Rechargeable battery 110 is in electrical communication with an external power supply, with electrical lines 108, and the array of LEDs 104. Rechargeable battery 110 may be disposed above the array of LEDs 104 or light source support 103. For example, a housing 102 may extend upward from light source support 103 and may house rechargeable battery 110.

Housing 102 may be configured for mounting emergency high bay light 100. For example, housing 102 may be configured to be attached to, or hung from, a ceiling. Housing 102 may be configured to be opened for accessing rechargeable battery 110 and circuitry housed therein. For example, housing 102 may be configured to be opened for the replacement of rechargeable battery 110.

Emergency high bay light 100 may be configured to charge rechargeable battery 110 with a power supply between about 100V AC and 480V AC. In at least one embodiment, emergency high bay light 100 is configured to be electrically connected to different voltages of power supply. For example, emergency high bay light 100 may be configured to electrically connect with a power supply having a first voltage and a power supply having a second voltage and charge battery 110, wherein the first voltage is different than the second voltage. For example, emergency high bay light 100 may have a terminal block 112 configured to connect to a variety of different voltages of power supply.

Terminal bock 112 may have more than one positive terminal for electrically connecting emergency high bay light 100 to a power supply. For example, terminal block 112 may have an N, negative or ground terminal 112*a*, a 277 V terminal 112*b*, a 347 V terminal 112*c*, and a 480 V terminal 112*d*. This may configure emergency high bay light 100 to be electrically connected to one of a variety of power supplies and charge battery 110, as may be desired.

In at least one embodiment, emergency high bay light 100 has a first terminal configured to electrically connect with the power supply having a first voltage and a second terminal configured to electrically connect with the power supply having a second voltage. In at least one other embodiment, emergency high bay light 100 is configured to electrically connect with a power supply having a voltage between about 100V AC and 277V AC, a voltage of about 347V AC, or a voltage of about 480V AC, and charge battery 110. In at least one additional embodiment, emergency high bay light 100 is configured to charge rechargeable battery 110 with a power supply of about 480V AC. In at least one further embodiment, emergency high bay light 100 is configured to charge rechargeable battery 110 with a power supply having a voltage of about 208V AC.

In at least one embodiment, emergency high bay light 100 has a transformer 105 configured to receive the power supply from terminal block 112 and charge battery 110. For example, a transformer 105 may be used for higher voltage supplies such as voltages above 277 V. In at least one other embodiment, emergency high bay light 100 is void of a driver.

In at least one embodiment, emergency high bay light 100 is configured to provide emergency egress light when installed at a height of at least 12 feet. For example, emergency high bay light 100 may be configured to provide emergency egress light when installed at a height of about 15 feet or more, or less. In at least one other embodiment, emergency high bay light 100 has a wattage of at least 10 W. For example, array of LEDs 104 may have a wattage of 10 W or more, such as 30 W for example.

Emergency high bay light 100 is configured to provide emergency lighting for at least 90 minutes. In at least one embodiment, emergency high bay light 100 may be configured to provide emergency light in excess of 90 minutes, for example emergency high bay light 100 may be configured to provide emergency light for 120 minutes or longer.

Emergency high bay light 100 may be configured to provide emergency lighting at a spot beam angle of light of at least 10 degrees or between about 10 degrees and about 120 degrees, as may be desired for selected applications. For example, emergency high bay light 100 may be configured to provide emergency lighting at a spot beam angle of light between about 10 degrees and about 60 degrees, as may be desired for emergency high bay applications.

In at least one embodiment, emergency high bay light 100 is IP65 water resistant. For example, emergency high bay light 100 may be protected against water jets from any angle as may be desired in industrial installations and/or in emergencies. For example, housing 102 may be configured to be substantially sealed when closed.

In at least one embodiment, emergency high bay light 100 is configured to be a stand-alone emergency light. For example, emergency high bay light 100 may be configured to provide emergency lighting without fitting of additional components.

In at least one embodiment of the present disclosure, emergency high bay light 100 is configured to be electrically connected to an uninterrupted power supply. As used herein, an uninterrupted power supply means that the power is being supplied with a dedicated circuit. The dedicated circuit typically has minimal circuit breakers and switches. For example, an uninterrupted power supply may have breakers or switches that are not easily accessible or they may be secured.

In another embodiment, emergency high bay light 100 may be configured to wirelessly communicate with a wireless communicator module. As disclosed in U.S. application Ser. No. 16/661,777, entitled "EMERGENCY LIGHTING SYSTEM AND METHOD FOR PROVIDING EMERGENCY LIGHT", filed Oct. 23, 2019, incorporated by reference herein, emergency high bay light 100 may be configured to receive a remote notification of a power outage. In this embodiment, emergency high bay light 100 may be in electrical communication with an interrupted and/or uninterrupted power supply. In the embodiment of emergency high bay light 100 configured to wirelessly communicate with a wireless communicator module, emergency high bay light 100 may additionally provide light as desired, in addition to emergency egress light, such as being configured to be switched on and off as desired.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A stand-alone emergency high bay light comprising:

a housing extending up from a circular light emitting surface;

an array of LEDs disposed with the light emitting surface and symmetrically about a central axis of the emergency high bay light;

a rechargeable battery configured and disposed to illuminate the array of LEDs;

the housing being configured to be opened and closed and removably hold the rechargeable battery;

wherein the emergency high bay light is configured to charge the rechargeable battery with a single uninterrupted power supply between about 100V AC and 480V AC; and the stand-alone emergency high bay light being configured to provide emergency egress light upon a power interruption in the sole-single uninterrupted power supply.

2. The stand-alone emergency high bay light of claim 1 being configured to electrically connect with the single uninterrupted power supply having a first voltage and the single uninterrupted power supply having a second voltage, wherein the first voltage is different than the second voltage.

3. The stand-alone emergency high bay light of claim 2 having a first terminal configured to electrically connect with the single uninterrupted power supply having the first voltage and a second terminal configured to electrically connect with the single uninterrupted power supply having the second voltage.

4. The stand-alone emergency high bay light of claim 1 being configured to electrically connect with the single uninterrupted power supply having a voltage between about 100V AC and 277V AC, a voltage of about 347V AC, or a voltage of about 480V AC.

5. The stand-alone emergency high bay light of claim 1 being configured to provide emergency egress light when installed at a height of at least 12 feet.

6. The stand-alone emergency high bay light of claim 1 further comprising a test switch and an indicator light, the test switch being configured for testing an operation of the stand-alone emergency high bay light and the indicator light being configured to indicate an operational status of the stand-alone emergency high bay light.

7. The stand-alone emergency high bay light of claim 1 being configured for wireless remote testing.

8. The stand-alone emergency high bay light of claim 7 being configured for the testing with a mobile device.

9. The stand-alone emergency high bay light of claim 1 having a lamp wattage of at least 10 W.

10. The stand-alone emergency high bay light of claim 1 being configured to provide emergency lighting for at least 90 minutes.

11. The stand-alone emergency high bay light of claim 1 having a spot beam angle of light of at least 10 degrees.

12. The stand-alone emergency high bay light of claim 11 having a spot beam angle of light between about 10 degrees and about 120 degrees.

13. An emergency high bay light comprising:

an array of LEDs disposed on a circular lower surface and symmetrically about a central axis of the emergency high bay light;

a housing extending up from the array of LEDs, the housing being configured to be opened and closed;

a rechargeable battery configured and disposed to illuminate the array of LEDs and to be removably held in the housing;

wherein the emergency high bay light is configured to charge the rechargeable battery with a single uninterrupted power supply between about 100V AC and 480V AC;

wherein the emergency high bay light is configured solely to provide emergency egress light at a height of at least 12 feet above the area of egress to be illuminated with the emergency high bay light; and wherein power supplied to the array of LEDs for the providing of the emergency egress light is supplied solely with the rechargeable battery, upon a power interruption in the single uninterrupted power supply.

14. The emergency high bay light of claim 13 being configured to electrically connect with the single uninterrupted power supply having a first voltage and the single uninterrupted power supply having a second voltage; and wherein the first voltage is different than the second voltage.

15. The emergency high bay light of claim 14 being configured to electrically connect with the single uninterrupted power supply having a third voltage, wherein the third voltage is different than the first voltage and the second voltage.

16. The emergency high bay light of claim 13 being configured to electrically connect with THE single uninterrupted power supply having a voltage between about 100V AC and 277V AC, a voltage of about 347V AC, or a voltage of about 480V AC, and to charge the rechargeable battery with the single uninterrupted power supply.

17. The emergency high bay light of claim 13 further comprising testing circuitry and an indicator for direct or remote testing of the operational status of the emergency high bay light.

18. The emergency high bay light of claim 13 having a spot beam angle of light of at least 10 degrees.

19. The emergency high bay light of claim 13 having a lamp wattage of at least 10 W.

* * * * *